US007789659B2

(12) United States Patent
Godon

(10) Patent No.: US 7,789,659 B2
(45) Date of Patent: Sep. 7, 2010

(54) FUEL INJECTOR, BURNER AND METHOD OF INJECTING FUEL

(75) Inventor: Gilles Godon, Jonquiére (CA)

(73) Assignee: 9131-9277 Quebec Inc., Jonquiere (Quebec) (CA)

( * ) Notice: Subject to any disclaimer, the term of this patent is extended or adjusted under 35 U.S.C. 154(b) by 1232 days.

(21) Appl. No.: 11/360,771

(22) Filed: Feb. 24, 2006

(65) Prior Publication Data

US 2007/0202449 A1 Aug. 30, 2007

(51) Int. Cl.
*F23G 7/08* (2006.01)
*F23D 14/46* (2006.01)

(52) U.S. Cl. ..... 431/202; 431/350; 431/351

(58) Field of Classification Search ..... 431/202, 431/350, 351, 5, 9
See application file for complete search history.

(56) References Cited

U.S. PATENT DOCUMENTS 2,570,771 A * 10/1951 Conron ..... 431/200
2,726,511 A * 12/1955 Pitt ..... 60/739
3,539,285 A * 11/1970 Reed et al. ..... 431/202
4,003,693 A * 1/1977 Straitz, III ..... 431/202
4,105,394 A * 8/1978 Reed et al. ..... 431/202
4,188,183 A * 2/1980 Zink et al. ..... 431/202
4,453,384 A 6/1984 Pask
6,048,510 A 4/2000 Zauderer
6,155,820 A 12/2000 Dobbeling et al.
6,196,835 B1 3/2001 Gutmark et al.
6,210,152 B1 4/2001 Haffner et al.
6,277,500 B1 8/2001 Konter et al.
6,672,863 B2 1/2004 Doebbeling et al.
6,722,295 B2 4/2004 Zauderer
6,880,339 B2 4/2005 Modi et al.
2004/0234912 A1 11/2004 Sarv et al.
2006/0199126 A1 * 9/2006 Tipper et al. ..... 431/202

* cited by examiner

*Primary Examiner*—Kenneth B Rinehart
*Assistant Examiner*—Chuka C Ndubizu
(74) *Attorney, Agent, or Firm*—Ogilvy Renault, LLP

(57) ABSTRACT

A primary flow of the burner air stream is slowed relatively to a secondary flow of the air stream. Fuel is injected at a lower rate into the primary flow, which generates a more stable flame, and fuel is injected at a higher rate into the secondary flow, which generates a stronger flame. If the stronger flame is blown out, fuel in the secondary flow can be lit by the flame from the primary flow.

23 Claims, 4 Drawing Sheets

FUEL INJECTOR, BURNER AND METHOD OF INJECTING FUEL

FIELD

The present improvements relate generally to the field of fuel injectors for burners.

BACKGROUND

Burners are well known, for example in furnaces, dryers, kiln or boilers. Typically burners have an air duct which ducts an air stream into a combustion chamber, and include one or more fuel injectors which inject fuel into the air stream and into the combustion chamber, where continuous combustion occurs. An example of a fuel injector is described in US Patent Application No. 2004/0234912 by Sarv et al. This fuel injector has a nozzle which injects fuel in a substantially conical spray.

Some existing fuel injectors provide a flame which is unstable. Such flames are known to cyclically change dimensions as the flame "catches up" with the supplied air and fuel. Unstable flames are prone to flameouts. If a flameout arises, fuel leaks into the combustion chamber. Some combustion chambers include flameout detectors to stop fuel supply in the event of a flameout. Lowering the risks of flameout is thus one of the main goals in the design of a burner.

Another one of the main goals in the art is to reduce combustion by-products. Regions of high temperature concentrations within a flame, known as hotspots, are known to generate by-products such as nitrogen oxides ($NO_x$). Optimizing the temperature distribution in the flame to avoid hotspots is thus another goal in the design of a burner or its fuel injector.

SUMMARY

An aim of the improvements is to alleviate some of the needs concerning burners.

In accordance with one aspect, there is provided a fuel injector for use within an air stream of a burner, the fuel injector having an incoming air side, a fuel injection side, and a central axis, the fuel injector comprising: a plurality of distribution conduits arranged substantially radially around the central axis, each distribution conduit having at least one radially spaced-apart injection aperture on the fuel injection side, each distribution conduit having a proximal end close to the central axis and an opposed distal end; a peripheral conduit interconnecting the distal ends of the distribution conduits and having a plurality of interspaced injection apertures, the fuel injection apertures defined in the peripheral conduit having a larger surface area from the fuel injection apertures defined in the distribution conduits; and a plurality of air deflectors, each air deflector being associated with at least one of the injection apertures of a respective one of the distribution conduits and being provided at the incoming air side, the air deflectors being configured and disposed to impart a rotary movement to a portion of the air stream, the air deflectors being configured and disposed to impart a rotary movement to a portion of the air stream.

In accordance with another aspect, there is provided a burner for use with a combustion chamber, the burner comprising: an air duct for ducting an air stream into the combustion chamber, a plurality of distribution conduits having an incoming air side, a fuel injection side, and a central axis, the distribution conduits being arranged substantially radially around the central axis, each distribution conduit having at least one radially spaced-apart injection aperture on the fuel injection side, each distribution conduit having a proximal end close to the central axis and an opposed distal end; a peripheral conduit interconnecting the distal ends of the distribution conduits and having a plurality of interspaced injection apertures, the fuel injection apertures defined in the peripheral conduit having a larger surface area from the fuel injection apertures defined in the distribution conduits; and a plurality of air generally flat deflectors, each air deflector being associated with at least one of the injection apertures of a respective one of the distribution conduits and being provided at the incoming air side, the air deflectors being configured and disposed to impart a rotary movement to a portion of the air stream, the air deflectors being configured and disposed to impart a rotary movement to a portion of the air stream.

In accordance with still another aspect, there is provided a method of injecting fuel in an air stream of a burner, the method comprising: reducing the axial speed of a primary flow of the air stream relatively to a secondary flow of the air stream by imparting a rotational movement to the primary flow, the secondary flow and the primary flow being concentric and imparting a rotational movement to the primary flow of air stream; injecting fuel in a circumferentially dispersed manner into the rotative primary flow at a first fuel injection rate, and injecting fuel in a circumferentially dispersed manner into the secondary flow at a second fuel injection rate, the second fuel injection rate being substantially greater than the first fuel injection rate, at least a portion of the fuel injected into the secondary flow being oriented outwardly of the primary flow of air stream.

In accordance with still another aspect, there is provided a burner for use with a combustion chamber and having an air incoming side and a fuel injection side, the burner comprising: an air duct for ducting an air stream into the combustion chamber; a plurality of air deflectors provided at the air incoming side, configured and disposed to slow a primary flow of the air stream relatively to a secondary flow of the air stream and to impart a rotary movement to the primary flow, the primary flow and the secondary flow being concentric with the secondary flow being peripheral to the primary flow; a plurality of dispersed first injection apertures configured and disposed to inject fuel at a first fuel injection rate substantially into the rotative primary flow of the air stream and in the fuel injection side; and a plurality of dispersed second injection apertures configured and disposed to inject fuel at a second fuel injection rate substantially into the secondary flow of the air stream and in the fuel injection side, the second fuel injection rate being substantially higher than the first fuel injection rate.

DESCRIPTION OF THE FIGURES

Further features and advantages of the present invention will become apparent from the following detailed description, taken in combination with the appended figures, in which.

It will be noted that throughout the appended figures, like features are identified by like reference numerals.

DETAILED DESCRIPTION

Figure 1:
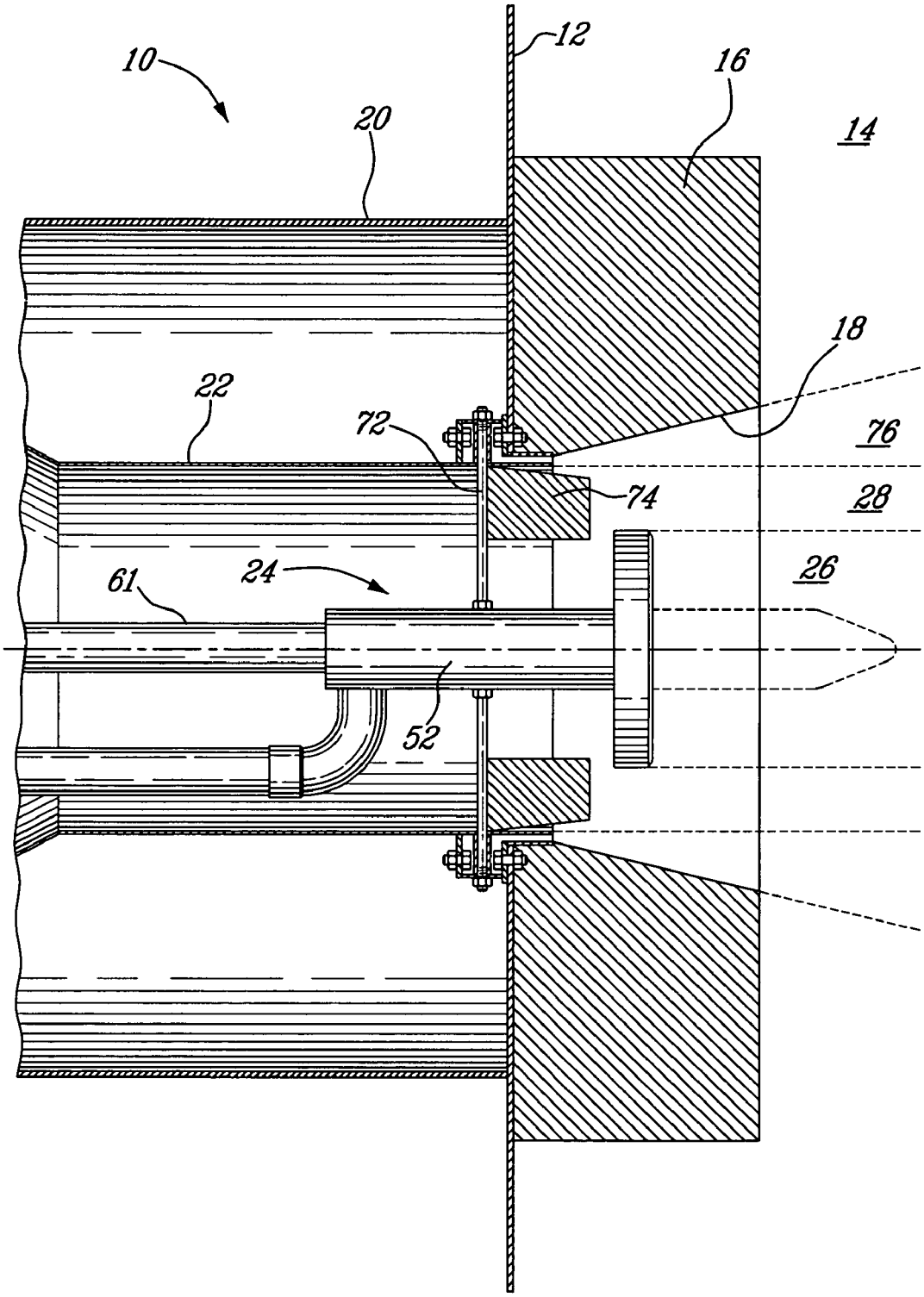
FIG. 1 is a side view showing an example of an improved fuel injector for a burner.

FIG. 1 shows an example of a burner 10 secured to a wall 12 of a combustion chamber 14. The combustion chamber 14 includes a quarl 16 of a refractory material which defines a throat 18 of truncated conical shape. The throat 18 communicates with an opening in the wall 12 of the combustion chamber 14. The burner 10 is enclosed within an outer casing 20, and includes an air duct 22 inside the casing 20, which communicates with the wall opening and the throat 18. The air duct 22 is adapted to duct an air stream into the combustion chamber 14. The air stream is generally created by a blower (not shown), although some small models could use naturally aspired air. A fuel injector 24 is disposed within the throat 18, in the path of the air stream. In the illustrated embodiment, the fuel injector 24 is held in position onto a secondary fuel conduit 61 and by a fuel intake conduit, and is maintained centered relative to the throat 18 by a plurality circumferentially arranged stems 72 (only two are shown). The stems 72 are secured to the air duct 22 and the combustion chamber wall 12 at the other end. The particular position of the injector 24 can be varied to influence the flame configuration, as will be described below. In the illustrated embodiment, the air duct 22 and the wall opening are cylindrical, and the fuel injector 24 is located concentrically within the throat 18. The burner 10 also includes a fuel igniter which is not shown. In use, the air stream comes from behind the injector 24, and air is then mixed with the injected fuel to burn in a continuous flame extending into the combustion chamber 14.

During operation, a portion of the air stream goes across the injector 24. This portion of the air stream will be referred to as the primary flow 26. Another portion of the air stream goes around the injector 24. That latter portion will be referred to as the secondary flow 28. As discussed further down, the primary flow 26 forced into a rotating movement as it travels across the injector 24, and the axial speed of the air in the primary flow 26 is thus slower relative to the secondary flow 28.

Figure 2:
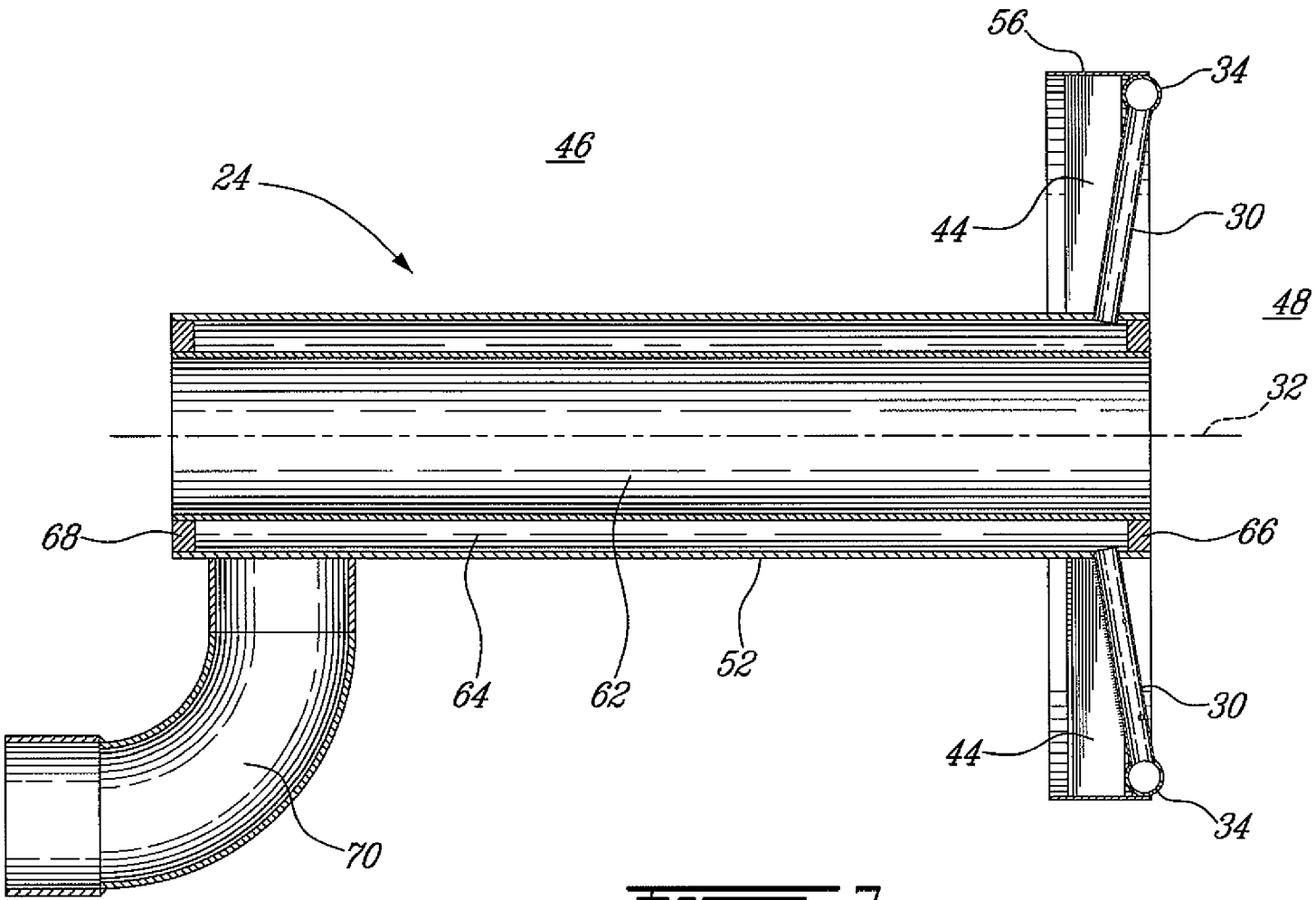
FIG. 2 is a cross-sectional view of the fuel injector of FIG. 1.
Figure 3:
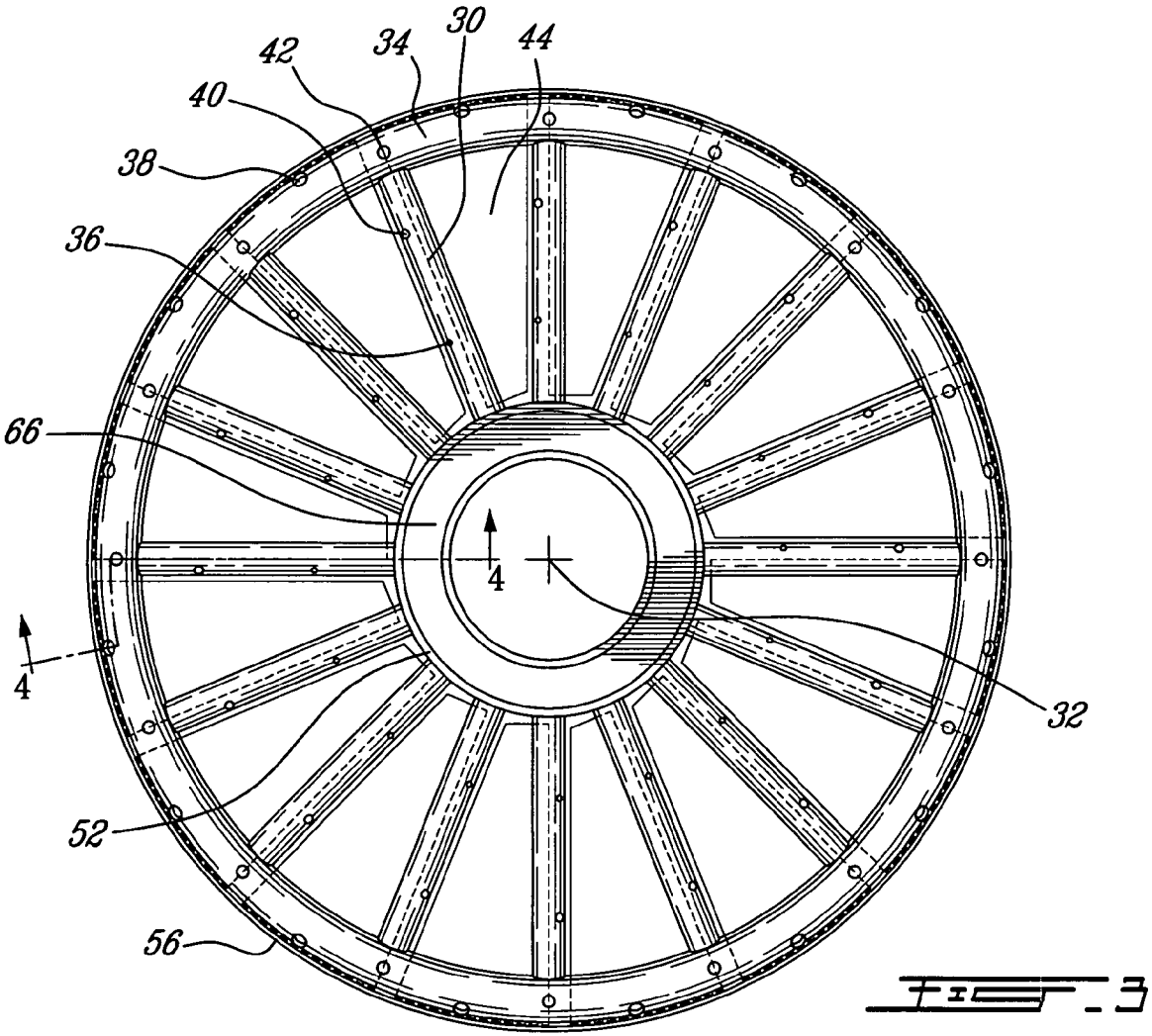
FIG. 3 is a front view of the fuel injector of FIG. 1.

Referring now to FIGS. 2 and 3, the improved fuel injector 24 is shown in better detail, it can be seen that the fuel injector 24 includes a plurality of distribution conduits 30 projecting substantially radially around a central axis 32. In the illustrated embodiment, the distribution conduits 30 are arranged in a regular array around the central axis 32. Each angular section including one distribution conduit 30 of the injector 24 is identical to the next. The distribution conduits 30 extend circumferentially into portions of a common peripheral conduit 34, better seen in FIG. 3. In the illustrated embodiment, four injection apertures (36, 38, 40, 42) are associated to each distribution conduit 30. A first injection aperture 36 is disposed at a first radial position along the length of a respective distribution conduit 30 and is configured to inject fuel into the primary flow 26 (FIG. 1). A second injection aperture 38 is disposed in the respective portion of the peripheral conduit 34 and is configured to inject fuel into the secondary flow 28. The second injection aperture 38 has a larger area than the first injection aperture 36, and therefore, the rate of fuel injection by the second injection aperture 38 is greater than the rate of fuel injection by the first injection aperture 36. A circumferentially dispersed fuel injection is achieved by angular spacing of the first injection apertures 36 or the second injection apertures 38 around the central axis 32. A radially dispersed fuel injection is achieved by the radial spacing between the first injection apertures 36 and the second injection apertures 38. In the illustrated embodiment, a third injection aperture 40 and a fourth injection aperture 42 are also present between the first injection aperture 36 and second injection aperture 38, as will be detailed further below.

To slow the mean axial speed of the primary flow 26 relative to the secondary flow 28 (FIG. 1), a plurality of deflector blades 44 are used in association with a respective first injection aperture 36. The deflector blades 44 impart a rotary movement to the air in the primary flow 26. In the illustrated embodiment, each deflector blade 44 is associated with a respective distribution conduit 30. The deflector blades 44 are inclined relative to the incoming air by a common angle and form a circular array. Incoming air encounters the deflector blades 44 and is forced to deviate from its generally axial course into a circumferential direction. The common action of circularly distributed deflector blades 44 generates a rotational movement in the primary flow 26.

Referring to FIG. 2, the fuel injector 24 has an incoming air side 46 and a fuel injection side 48. The deflector blades 44 are on the incoming air side 46, whereas the injection apertures (36, 38, 40, 42) are on the fuel injection side 48.

The distribution conduits 30 have a proximal end 50 connected to a common manifold 52, and an opposed distal end 54. In the illustrated embodiment, the distal ends 54 of the plurality of distribution conduits 30 are open and are interconnected by the peripheral conduit 34 in which fuel is free to circulate. The peripheral conduit 34 forms a plurality of interconnected extensions to the distribution conduits 30. In the illustrated embodiment, the distribution conduits 30 are slightly inclined towards the fuel injection side 48, with respect to the central axis 32, and are therefore disposed in a somewhat conical arrangement. In the illustrated embodiment, they are inclined by about 12° with respect to a vertical plane, and a peripheral band 56 is secured around the peripheral conduit 34. The band 56 is made of a flat plate curved into a circle and affixed around the peripheral conduit. The flat of the band is oriented in the axial direction.

Figure 4:
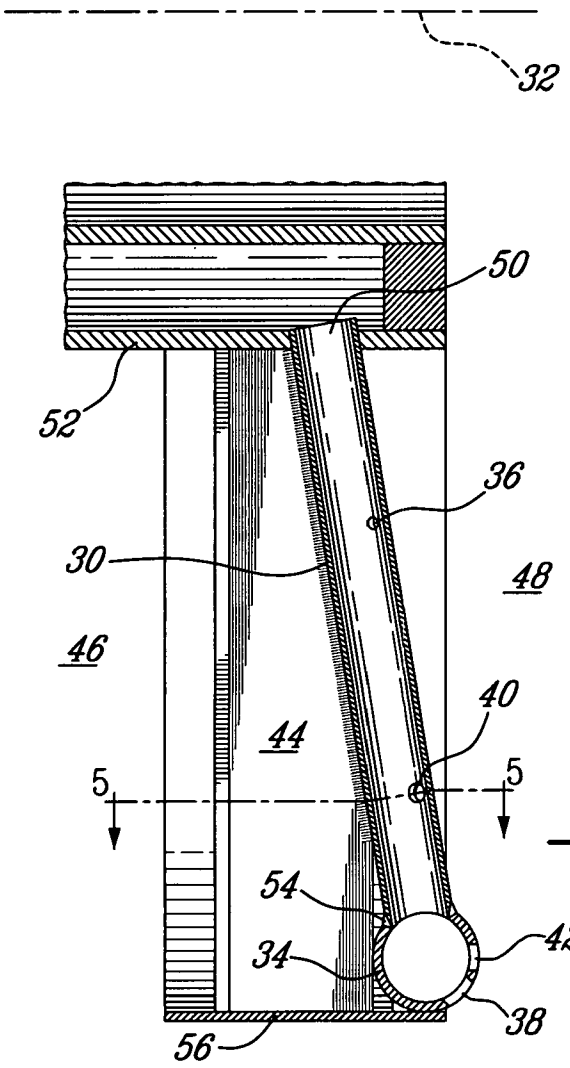
FIG. 4 a cross-sectional view taken along line 4-4 of FIG. 3.

As shown in FIGS. 3 and 4, in the illustrated embodiment, four injection apertures 36, 38, 40, 42 are associated which each distribution conduit 30. The first injection aperture 36 and the third injection aperture 40 are disposed along the length of the respective distribution conduit 30. The second injection aperture 38 and the fourth injection aperture 42 are in the peripheral conduit 34.

The proximal end 50 of each distribution conduit 30 is open and allows fuel flowing into it from the manifold 52. The first injection aperture 36 is provided at a first radial position along the length of distribution conduit 30, and the third injection aperture 40 is provided at a second radial position along the distribution conduit 30. The third injection aperture 40 is closer to the distal end 54. This is more clearly illustrated with reference to FIG. 4, where it is also shown that fuel can flow freely between the central manifold 52 and the peripheral conduit 34. Referring now to FIG. 3, like the second injection aperture 38, the fourth injection aperture 42 is provided in the peripheral conduit 34. The angular position of the fourth injection aperture 42 is in line with the respective distribution conduit 30. The fourth injection aperture 42 is oriented in a direction parallel to the central axis, i.e. at 90° from a plane defined by the peripheral conduit. The second injection aperture 38 is provided in the peripheral conduit 34 at an angular position which is between the angular position of two adjacent distribution conduits 30. The second injection aperture 38 is oriented at about 45° with respect to a vertical plane, and are oriented generally toward the secondary flow 28 (FIG. 1). The particular orientation is not critical.

The second injection aperture 38 and fourth injection aperture 42 are adapted to inject fuel mostly into the secondary flow 28, whereas the first injection aperture 36 and third injection aperture 40 are positioned to inject fuel mostly into the primary flow 26 (FIG. 1). It will be understood that an area of lower air pressure, or depression, is created downstream of the deflector blades 44. Air flowing in the secondary flow 28 is somewhat deviated into the depression, where it mixes with the primary flow 26. Also, some of the air which is aligned with the deflector blades 44 upstream of the fuel injector 24 is forced around the fuel injector 24, into the secondary flow 28. In the illustrated embodiment, the injection apertures (36,38, 40,42) are made progressively larger as they are progressively located further away from the manifold 52. As a result, the rate of fuel injection from the second injection aperture 38 and fourth injection aperture 42 into the secondary flow 28 is substantially greater than the rate of fuel injection from the first injection aperture 36 and third injection aperture 40 into the primary flow 26. The resulting flame in the primary flow 26 is then more stable, and stability is maintained at low fuel injection pressures. A higher rate of fuel can thus be injected in the secondary flow 28, and the flame in the primary flow 26 will allow reigniting the flame of the secondary flow 28 if flameout occurs.

Figure 5:
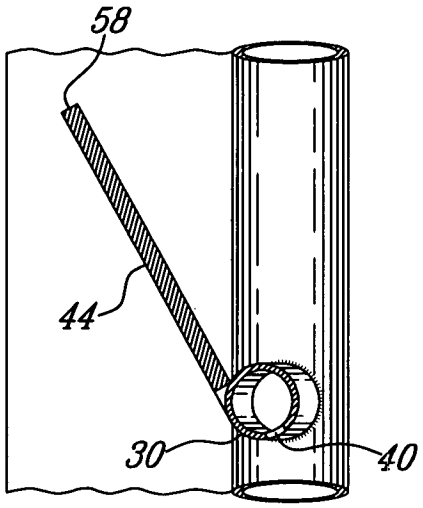
FIG. 5 is a cross-sectional view taken along line 5-5 of FIG. 4.

Referring now to FIG. 5, it is shown that an edge of a deflector blade 44 is affixed to a respective distribution conduit 30 and extends tangentially from it in a direction which opposes the direction of fuel injection from the first injection aperture 36 and third injection aperture 40. Hence, the air from the incoming air side 46 is deflected by the deflector blade 44 and exits with a velocity component which is directed in the direction of fuel injection. Adapting the axial speed of the air to the speed of the injected fuel allows to adjust the air/fuel ratio for combustion. This plays a role in the configuration of the obtained flame and in the efficiency of the burner 10. The edge 58 of the deflector 44 which is opposite the distribution conduit 30 is inclined towards the direction of incoming air at an angle of about 30°. In this embodiment, the direction of the first injection aperture 36 and third injection aperture 40, which are located along the distribution conduit 30, is aligned in the direction opposite the deflector blade 44. This brings fuel injection from the distribution conduits 30 into alignment with the rotating primary flow 26 of air.

Figure 6:
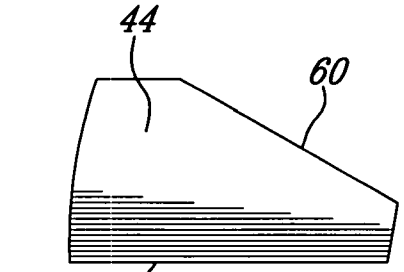
FIG. 6 is a plan view of a deflector blade of the fuel injector of FIG. 1.

FIG. 6 illustrates the contour of the deflector blades 44 used in the illustrated embodiment, being a simple flat plate in this case. The deflector blades 44 are shaped for fitting into the band 56 while having one edge 60 disposed along the length of the respective distribution conduit 30. The deflector blades 44 are on the incoming air side, relative to the distribution conduits 30. In this case, they are affixed to the band 56 and the distribution conduits 30 so as to form a regular array with the equally spaced distribution conduits 30.

Referring back to FIG. 2, the manifold 52 in the illustrated embodiment is in registry with the central axis 32. Furthermore, the manifold 52 is tubular, and is adapted to fit around an alternative fuel pipe 61(FIG. 1). The alternative fuel pipe 61 is optional, and the manifold 52 can alternately be provided as a simple pipe. To adapt to the alternative fuel pipe 61, the manifold includes an inner tube 62 and an outer tube 64 being concentrically arranged and closed at each end by manifold caps 66, 68. The inner tube 62 can be sled onto the alternative fuel pipe 61 of appropriate dimension, and the manifold 52 can provide a tubular flow of fuel around the alternative fuel pipe 61. At its end opposite the distribution conduits 30, the manifold 52 has a fuel inlet 70.

Referring back to FIG. 1, the deflector blades 44 (FIG. 3) impart a rotary movement to the air in a first angular direction and slow the axial speed of the primary flow 26. In the illustrated embodiment, vanes 74 are mounted to the stems 72, and impart a rotational movement to the secondary flow 28. The inclination of the vanes 74 is less pronounced than the inclination of the deflector blades 44 (FIG. 3), and therefore, the rotational movement of the secondary flow 28 is less pronounced than the rotational movement in the primary flow 26. The axial velocity of the secondary flow 28 is greater than the axial velocity of the primary flow 26 and a depression is created on the fuel injection side 48 of the fuel injector 24 (FIG. 2). Depending on the desired flame geometry, the vanes 74 are arranged to impart a rotary movement which can be in the same angular direction, or in the opposite angular direction than the rotational movement imparted by deflector blades 44 of the fuel injector 24. As it was seen above, the fuel injector 24 injects fuel in a dispersed manner into both the primary flow 26 and the secondary flow 28. The resulting flame is spread over the overall region of fuel injection. By generating a flame which is stable in one of the flows, like the primary flow 26 in the illustrated embodiment, it is allowable to generate a stronger but less stable flame in the other flow, like the secondary flow 28 in the example. In the case of flameout of the less stable flame in the secondary flow 28, the fuel injected in that flow will be reignited by the more stable flame of the primary flow 26.

In the illustrated embodiment, the burner further includes a tertiary flow 76 from an annular jet of pressurized air injected at the periphery of the throat 18 by an air injector which is fed pressurized air from an external source. The tertiary flow 76 is somewhat peripheral to the secondary flow 28. The tertiary flow 76 is used to further direct the fuel injected by the second injection apertures 38 (FIGS. 3 and 4) into the combustion chamber 14, and away form the quart 16.

The rotational swirl imparted in the primary 26 and the secondary 28 flows can both be clockwise (CW) or both be counterclockwise (CCW). In either case where they are in a common angular direction, the flame will tend to be long and penetrate deeply into the combustion chamber 14. Alternately, the rotation in the primary 26 and secondary flows 28 can be opposite, which will tend to result in a broader, shorter flame which is suitable for example in applications where the opposite wall of the combustion chamber 14 is not far away.

The depth of penetration of the fuel injector 24 within the throat 18, the axial speed of the secondary 28 and tertiary 76 flows, the pressure of the fuel, and the position and size of the injection apertures (36, 38, 40, 42) can be varied to adjust the path of injection of the fuel in the air stream. Typically, it will be desired that the path of the injected fuel in the secondary flow 28 and tertiary flow 76 clear the edges of the throat 18 to travel freely into the combustion chamber. In other applications, it may alternately be desired that the path of fuel injection impinge against the surface of the throat 18.

To achieve better combustion of the fuel, one can adjust the velocity at which the fuel is injected into the air flow relatively to the velocity of the air flow. This allows enhancing the ratio of air present for combustion of the gas and to vary the depth of penetration of the flame. For indicative purposes, with a system substantially as illustrated, with a peripheral conduit 34 having 12" in diameter, with first injection aperture 36, third injection aperture 40, fourth injection aperture 42, and second injection aperture 38 of 0.0625", 0.1250", 0.1875" and 0.2500", respectively, and using natural gas as the fuel, a fuel pressure of between 21 and 25 psi was maintained. This allowed to propel the fuel in the secondary flow 28 at an axial velocity which resulted in a deep flame having a more evenly distributed temperature concentration, which resulted in lower $NO_x$ concentrations. This is at least partially due to the secondary flow 28 and possibly the tertiary flow 76 if any, which constantly supply air to the peripherally injected fuel. The air from the secondary flow 28 mixes with the fuel in the flame. Further, the secondary flow 28 is partly deviated toward the central region by the depression created behind the injector due to aerodynamic drag caused by the fuel injector 24. A good flame stability was obtained in the primary flow 26 even at low fuel pressure. Stability was maintained across high/low fuel pressure ratios of 20:1. At high intensity, 250 MBtu/h were obtained.

The angle of the deflector blades 44 is chosen as a function of the axial velocity of the incoming air. In most applications, the higher the velocity of incoming air will be, the better it will be to reduce the angle of the deflector blades 44 to reduce the axial velocity of the incoming air and to reduce the probability of the primary flame being blown out. In an alternate embodiment, the angle of the deflector blades can be adjustable during use, to optimize the axial velocity of the primary flow to different combustion intensities.

Those skilled in the art will understand that many modifications to the illustrated embodiment are possible. For example, the manifold 52 can be a simple tube into which a minimum of three distribution conduits 30 are connected in fuel flow communication. The distribution conduits 30 would not necessarily be on a common conical surface and could be unevenly interspaced. At least two radially spaced injection apertures are provided in relation to each distribution conduit, one nearer to the distal end than the other. In one alternate embodiment, the distal ends of the distribution conduits are capped, the peripheral conduit is omitted, and both injection apertures are in the distribution conduits. In an other alternate embodiment, the distal ends are not capped and a peripheral conduit is used, and the second aperture which is said to be nearer to the distal end is provided in the peripheral conduit, and not necessarily aligned with the distribution conduit.

In an other alternate embodiment, the deflector blades are provided separately from the fuel injector, for example as part of the burner assembly upstream of the fuel injection, where they accomplish a similar function than in the embodiment where they are incorporated with the fuel injector. In another embodiment, the deflector blades are distribution conduits having a deflector blade shape. The shape, and particularly the cross-section of the distribution conduits can be modified from the straight circular shape described above. Further, although a regular array of deflector blades in the injector was described above, an irregular array can alternately be used.

Many aerodynamic design modifications can be made to the illustrated design, as it will appear to those skilled in the art. For example, the band 56 could have an airfoil shape, and either one of the deflector blades and the vanes, or both, could have a more complex three-dimensional curved shape adapted to impart a tangential swirl of a predetermined configuration. The band 56 is optional. In an alternate embodiment the band 56 can be made to project past the peripheral conduit toward the fuel injection side and act as a cut-off between the primary and secondary air flows.

As discussed above, one basic principle is to generate a primary flow and a secondary flow, the primary flow having a lower axial velocity than the secondary flow and being adapted to provide a stable flame from which the flame in the secondary flow can be reignited in the event of flameout. In an alternate embodiment, the secondary flow can be central to the primary flow.

In the illustrated embodiment, the distribution conduits were disposed on a common conical surface inclined by about 12° with respect to a plane located normal to the axis of the manifold. To modify the shape of the flame, the inclination of the distribution conduits can be varied between 10° and 14°. In alternate embodiments, it can further be varied and even be negative.

The particular burner configuration illustrated is exemplary and can be modified by those skilled in the art. In particular, the tertiary flow is optional and could be omitted. Alternately, the tertiary flow could be generated by a plurality of circumferentially interspaces pressurized air sources. The vanes for swirling the secondary flow are also optional. Many modifications can readily be devised.

The fuel injector can use other gaseous fuels than natural gas. Further combined use a liquid fuel can prove advantageous in certain applications. In other applications, it may be desired to use a double manifold, and two sets of distribution conduits, to use two different types of fuel in the same or different flows of the air stream.

In the illustrated embodiment, the alternative fuel used is oil. Other alternative fuels can be used as it will appear to those skilled in the art, and use of an alternative fuel can be entirely omitted. Therefore, the alternative fuel pipe is optional. If it is omitted, the manifold can be a single pipe, instead of being tubular, for example. The shape and size of the manifold can further be modified as it will appear to those skilled in the art, and the manifold is not necessarily unique or central. For example, in an alternate embodiment, the peripheral conduit can be used as the manifold. In another alternate embodiment, there can be two or more manifolds to feed the different injection apertures.

As it can be seen therefore, the embodiments described above and illustrated are intended to be exemplary only. Hence, the scope of the improvements is intended to be limited solely by the scope of the appended claims.

What is claimed is:

1. A fuel injector for use within an air stream of a burner, the fuel injector having an incoming air side, a fuel injection side, and a central axis, the fuel injector comprising:

a plurality of distribution conduits arranged substantially radially around the central axis, each distribution conduit having at least one injection aperture on the fuel injection side, each distribution conduit having a proximal end close to the central axis and an opposed distal end;

a peripheral conduit interconnecting the distal ends of the distribution conduits and having a plurality of interspaced injection apertures, the fuel injection apertures defined in the peripheral conduit having a larger surface area from the at least one fuel injection aperture defined in the distribution conduits; and a plurality of generally flat air deflectors, each air deflector being associated with a respective one of the distribution conduits and being provided at the incoming air side, the air deflectors being configured and disposed to impart a rotary movement to a portion of the air stream.

2. The fuel injector of claim 1 wherein the air deflectors are inclined relatively to a plane defined by the distribution conduits and relatively to the air stream.

3. The fuel injector of claim 1 wherein the at least one injection aperture defined in the distribution conduit comprises a first injection aperture close to the central axis and a second injection aperture radially spaced-apart from the first injection aperture and close to the distal end, the second injection aperture having a larger area than the first injection aperture.

4. The fuel injector of claim 3 wherein the first injection aperture has a direction and the second injection aperture has a direction substantially parallel to the direction of the first injection aperture.

5. The fuel injector of claim 1 further comprising a central manifold disposed along the central axis and being adapted and configured to supply fuel to each one of the distribution conduits, the central manifold being annular and including an inner conduit for an alternative fuel inside the annulus.

6. The fuel injector of claim 1 wherein each deflector is affixed to the respective one of the distribution conduits and extend tangentially from the distribution conduits in a direction opposite to the direction of at least one of said at least one injection aperture.

7. The fuel injector of claim 1, wherein the at least one injection aperture defined in the distribution conduits has a direction substantially parallel to the deflector affixed to the respective one of the distribution conduits.

8. The fuel injector of claim 1, wherein the peripheral fuel conduit comprises a first set of injection apertures having a direction oriented outwardly relatively to the central axis.

9. The fuel injector of claim 8, wherein the peripheral fuel conduit comprises a second set of injection apertures having a direction generally perpendicular to a plane defined by the peripheral conduit.

10. A burner for use with a combustion chamber, the burner comprising:

an air duct for ducting an air stream into the combustion chamber, a plurality of distribution conduits having an incoming air side, a fuel injection side, and a central axis, the distribution conduits being arranged substantially radially around the central axis, each distribution conduit having at least one injection aperture on the fuel injection side, each distribution conduit having a proximal end close to the central axis and an opposed distal end;

a peripheral conduit interconnecting the distal ends of the distribution conduits and having a plurality of interspaced injection apertures, the fuel injection apertures defined in the peripheral conduit having a larger surface area from the at least one fuel injection aperture defined in the distribution conduits; and a plurality of generally flat air deflectors, each air deflector being associated with a respective one of the distribution conduits and being provided at the incoming air side, the air deflectors being configured and disposed to impart a rotary movement to a portion of the air stream.

11. The burner of claim 10 wherein the distribution conduits, the peripheral conduit, and the air deflectors are disposed in a substantially circular injector area normal to the central axis, the injector area being substantially centered within the air stream and being disposed to allow air flowing outside the injector area.

12. The burner of claim 11 wherein a plurality of the injection apertures defined in the peripheral conduit is configured and disposed to inject fuel into the air flowing outside the injector area.

13. The burner of claim 10 wherein the at least one injection aperture defined in the distribution conduit comprises a first and a second injection apertures, and the second injection aperture has a larger area and is spaced farther away from the central axis than the first injection aperture.

14. The burner of claim 13 wherein the first and the second injection apertures have a respective direction and their respective direction is substantially parallel to one another and oriented in a direction substantially parallel to the deflector affixed to the respective one of the distribution conduits.

15. The burner of claim 13, wherein the peripheral fuel conduit comprises a first set of injection apertures having a direction oriented outwardly relatively to the central axis and a second set of injection apertures having a direction generally perpendicular to a plane defined by the peripheral conduit.

16. The burner of claim 10 wherein the air deflectors are inclined relatively to a plane defined by the distribution conduits and the peripheral conduit and relatively to the air stream.

17. A method of injecting fuel in an air stream of a burner, the air stream going at a mean axial speed, the method comprising:

reducing the mean axial speed of a primary flow of the air stream relatively to a secondary flow of the air stream, the secondary flow and the primary flow being concentric and imparting a rotational movement to the primary flow of air stream; injecting fuel in a circumferentially dispersed manner into the rotative primary flow at a first fuel injection rate, and injecting fuel in a circumferentially dispersed manner into the secondary flow at a second fuel injection rate, the second fuel injection rate being substantially higher than the first fuel injection rate, at least a portion of the fuel injected into the secondary flow being oriented outwardly of the primary flow of air stream.

18. The method of claim 17 wherein the secondary flow is peripheral to the primary flow.

19. The method of claim 17 wherein the fuel injected into the primary flow is also dispersed radially.

20. A burner for use with a combustion chamber and having an air incoming side and a fuel injection side, the burner comprising:

an air duct for ducting an air stream into the combustion chamber;

a plurality of air deflectors provided at the air incoming side, configured and disposed to slow a primary flow of the air stream relatively to a secondary flow of the air stream and to impart a rotary movement to the primary flow, the primary flow and the secondary flow being concentric with the secondary flow being peripheral to the primary flow;

a plurality of dispersed first injection apertures configured and disposed to inject fuel at a first fuel injection rate substantially into the rotative primary flow of the air stream and in the fuel injection side;

a plurality of dispersed second injection apertures configured and disposed to inject fuel at a second fuel injection rate substantially into the secondary flow of the air stream and in the fuel injection side, the second fuel injection rate being substantially higher than the first fuel injection rate;

a plurality of distribution conduits extending substantially radially from a central axis, wherein each first injection aperture is in a respective distribution conduit; and is oriented in a direction substantially parallel to the respective air deflector affixed to the respective one of the distribution conduits; and a plurality of third injection apertures, each third injection aperture being in a respective distribution conduit and being radially spaced apart from a respective first injection aperture with the first injection apertures being closer to the central axis and having a smaller area than the third injection apertures.

21. The burner of claim 20 wherein the air deflectors are circumferentially interspaced around a central axis.

22. The burner of claim 20 wherein each distribution conduit has a distal end opposite the central axis, the distal ends of each distribution conduits are interconnected by a peripheral conduit, and the plurality of second injection apertures are in the peripheral conduit.

23. The burner of claim 20, wherein at least a portion of the fuel injected by the second injection apertures is oriented outwardly of the primary flow of air stream.

* * * * *